US010143904B2

(12) United States Patent
Chaudy

(10) Patent No.: US 10,143,904 B2
(45) Date of Patent: Dec. 4, 2018

(54) GAME OF SKILL FOR PROPELLING AND RECEIVING A PROJECTILE

(71) Applicant: André Chaudy, Wezembeek-Oppem (BE)

(72) Inventor: André Chaudy, Wezembeek-Oppem (BE)

(73) Assignee: FLEXSOFUN, Namur (BE)

( * ) Notice: Subject to any disclaimer, the term of this patent is extended or adjusted under 35 U.S.C. 154(b) by 0 days.

(21) Appl. No.: 15/554,385

(22) PCT Filed: Feb. 25, 2016

(86) PCT No.: PCT/EP2016/053947
§ 371 (c)(1),
(2) Date: Aug. 29, 2017

(87) PCT Pub. No.: WO2016/139115
PCT Pub. Date: Sep. 9, 2016

(65) Prior Publication Data

US 2018/0043228 A1 Feb. 15, 2018

(30) Foreign Application Priority Data

Mar. 4, 2015 (BE) ..... 2015/0096

(51) Int. Cl.

| | |
|---|---|
| ***A63B 65/12*** | (2006.01) |
| ***A63B 67/18*** | (2016.01) |
| *A63B 67/187* | (2016.01) |
| *A63B 67/00* | (2006.01) |

(52) U.S. Cl.
CPC ..... *A63B 65/125* (2013.01); *A63B 67/18* (2013.01); *A63B 67/002* (2013.01); *A63B 67/187* (2016.01)

(58) Field of Classification Search
CPC ..... A63B 65/125
USPC ..... 473/505, 510, 511
See application file for complete search history.

(56) References Cited

U.S. PATENT DOCUMENTS

| | | | | |
|---|---|---|---|---|
| 1,170,948 A * | 2/1916 | Achershaug | ..... | A63B 65/125 473/511 |
| 2,201,802 A * | 5/1940 | Steiner | ..... | A63B 65/125 473/511 |
| 2,224,453 A * | 12/1940 | Hansen | ..... | A63B 65/125 473/511 |
| 2,835,494 A * | 5/1958 | Hull | ..... | A63B 65/125 473/511 |

(Continued)

FOREIGN PATENT DOCUMENTS

| | | |
|---|---|---|
| DE | 2423421 A1 | 11/1975 |
| DE | 29617003 U1 | 12/1996 |

OTHER PUBLICATIONS

International Search Report for corresponding application PCT/EP2016/053947 dated May 18, 2016.

(Continued)

*Primary Examiner* — Alexander Niconovich
(74) *Attorney, Agent, or Firm* — Norris McLaughlin P.A.

(57) ABSTRACT

The invention concerns a gaming device (1) to throw and catch a ball or a shuttlecock comprising a basket (20) structured around two rigid walls (21, 23) and elastic means (22, 24) for throwing the ball or the shuttlecock with a certain velocity by stretching the gaming device (1), while making it easier to catch the projectile in the structured basket (20) when the gaming device (1) is in resting position.

12 Claims, 3 Drawing Sheets

(56) References Cited

U.S. PATENT DOCUMENTS 2,972,480 A * 2/1961 Mitsuo Tanaka .... A63B 65/125 473/511
3,342,491 A * 9/1967 Padovani ..... A63B 65/125 124/79
3,467,381 A * 9/1969 Kreiss ..... A63B 21/00043 124/41.1
3,724,058 A * 4/1973 Dahl ..... A63B 65/125 29/417
3,905,600 A * 9/1975 Bourdamis ..... A63B 65/12 220/491
4,162,072 A * 7/1979 Schultze ..... A63B 65/125 473/511
4,234,183 A * 11/1980 Stephens ..... A63B 65/125 473/505
4,266,778 A * 5/1981 Sine ..... A63B 67/083 124/79
4,844,478 A * 7/1989 Kessler ..... A63B 41/00 473/474
4,938,484 A * 7/1990 Davis, Jr. ..... A63B 65/125 473/511
5,301,954 A * 4/1994 Wotring ..... A63B 65/125 273/DIG. 30
5,836,839 A * 11/1998 Kay ..... A63B 65/125 473/511
7,878,929 B2 * 2/2011 Perry-Smith ..... A63H 27/14 473/505
2002/0151391 A1 * 10/2002 Gelinas ..... A63B 65/125 473/511

OTHER PUBLICATIONS

Written Opinion of the International Searching Authority for corresponding application PCT/EP2016/053947 dated May 18, 2016 (English translation not available).

* cited by examiner

GAME OF SKILL FOR PROPELLING AND RECEIVING A PROJECTILE

This application is a § 371 U.S. National stage of PCT International Patent Application No. PCT/EP2016/053947, filed Feb. 25, 2016, which claims foreign priority benefit of Belgium Patent Application No. BE2015/0096, filed Mar. 4, 2015, the disclosures of each of which patent applications are incorporated herein by reference.

FIELD OF INVENTION

The invention relates to a device that throws a projectile in air and catches it, such as a ball or a shuttlecock, as a part of a sporting or recreational activity.

PRIOR ART

There are numerous devices for throwing and catching a projectile. For example, the document U.S. Pat. No. 4,234,183 describes a device with a flexible and flat surface to throw a projectile. On both ends of the flexible surface, handles are provided to operate the device. The flexible surface has an opening to catch the projectile. When the device is stretched by pulling the handles away from one another, the flexible surface tightens and launches the projectile. The user must then catch the projectile at the opening.

This device has certain limitations. Firstly, the device does not seem easy to handle due to the position of the handles. Prior art devices generally have means of gripping provided in the anteroposterior direction with respect to the human body when a user uses these devices. This results in discomfort of use when the projection surface needs to be kept parallel to the ground due to the unusual position of the hands. This can lead to a difficulty while handling the device.

Furthermore, a certain tension must be applied to the flexible surface to propel the projectile with greater force, which can be exhausting. Moreover, such a device does not easily throw a projectile with great force. Lastly, catching the projectile with a flat and flexible surface seems difficult. The projectile is likely, in case of a slight rebound on the flexible surface, to fall out from the device.

SUMMARY OF THE INVENTION

The invention and preferred embodiments of the invention are as described herein.

One of the purposes of this invention is to provide a device that is easy to handle and which can manually and easily throw a projectile with considerable propulsion force. Another purpose of this invention is to provide a device that makes it easier to catch the projectile.

For this purpose, the device according to the invention includes a basket for throwing and catching. The basket is open at the top. Two opposing handles are provided on both ends of the basket.

The device is characterised in that the basket has two rigid and opposing sidewalls. They are interconnected by two primary parts respectively forming a front and a rear wall of the basket and which include flexible elastic means. The two rigid sidewalls are further interconnected by a secondary non-elastic part forming a bottom wall of the basket. The rigid sidewalls also include a top edge that coincides with a side edge of the top opening of the basket. Moreover, each handle is connected to a top edge by the means of tertiary non elastic parts. In other words, each of the handles is connected to one of the top edges so that when the handles are moved laterally, the upper edges of the side walls move away from each other, while the bottom halves of the side walls separate and are held from each other at a maximum distance defined by a length of the second non elastic systems.

With such a device, it is easy to throw a ball in air with adequate projectile force without any increased effort on the part of the player due to the projection basket which, when subject to tension, flattens and throws the ball in air. The movement required to throw the projectile is limited, facilitating movement and reducing fatigue. When the device is no longer subject to tension, the primary elastic parts enable the projection and reception basket to go back to its resting position, making it easier to catch the projectile in the basket.

In a preferred embodiment, the primary parts forming the front and the rear wall of the basket are flexible and elastic means. This embodiment allows a greater range of motion and facilitates the flattening of the basket when the gaming device is stretched.

BRIEF DESCRIPTION OF THE FIGURES

These as well as other aspects of the invention will be clarified in the detailed description of the specific embodiments of the invention, reference being made to the drawings of figures, in which.

The drawings of the figures are not to scale. Generally, similar parts are denoted by similar references in the figures. The presence of reference numbers in the drawings cannot be considered as limiting.

DETAILED DESCRIPTION OF SPECIFIC EMBODIMENTS

Figure 1:
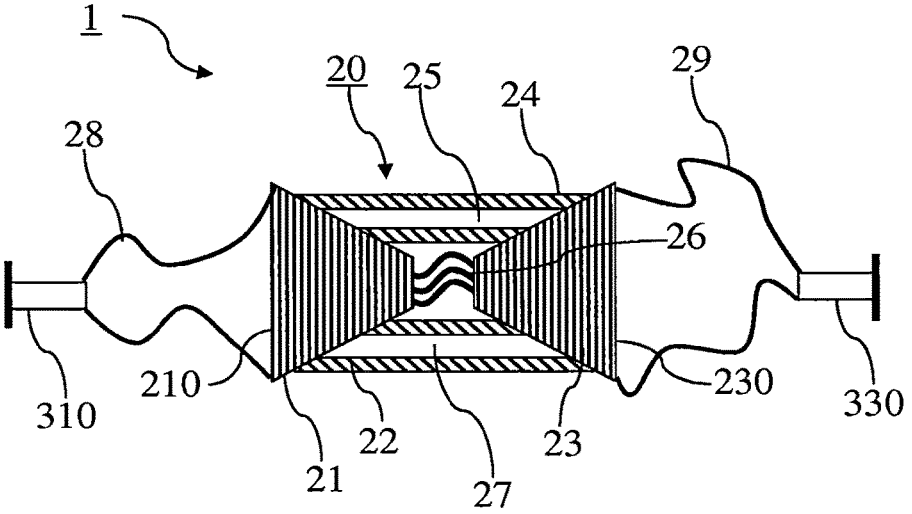
FIG. 1 is a top view of the gaming device in resting position as per a first embodiment of the invention.
Figure 2:
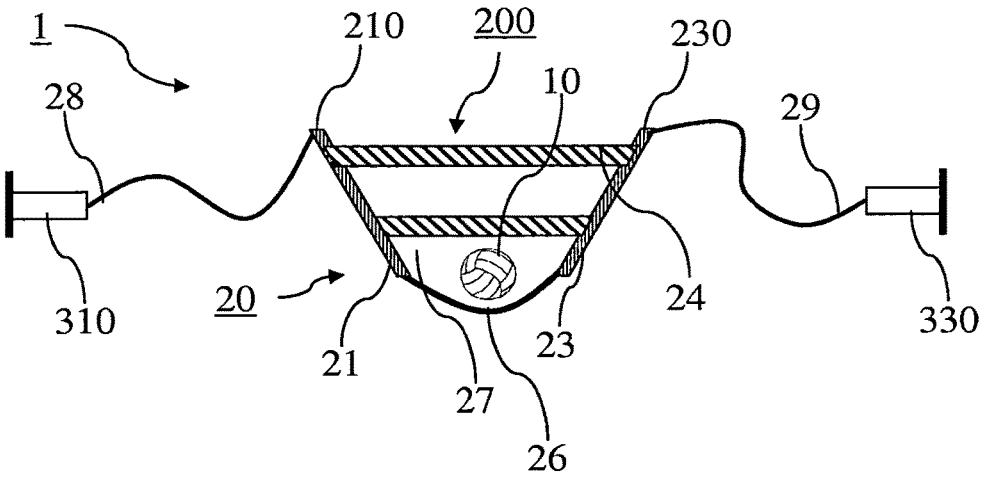
FIG. 2 is a side view of the gaming device from FIG. 1.

Firstly, refer to FIG. 1 and FIG. 2. The gaming device (1) has two handles (310, 330). The two handles (310, 330) are provided on both ends of a basket (20). The basket allows throwing the projectile in air and catching it. A basket is a three-dimensional structure which has a top opening (200) demarcated by an edge. The dimensions of the opening are such that they allow the projectile to pass through. The side surfaces and one bottom surface of the basket (20) are closed or have openings that do not allow the projectile to pass through. For example, the side surfaces may be arranged in the form of long parallel strips or a net, whose openings are smaller than the projectile's size.

Figure 4:
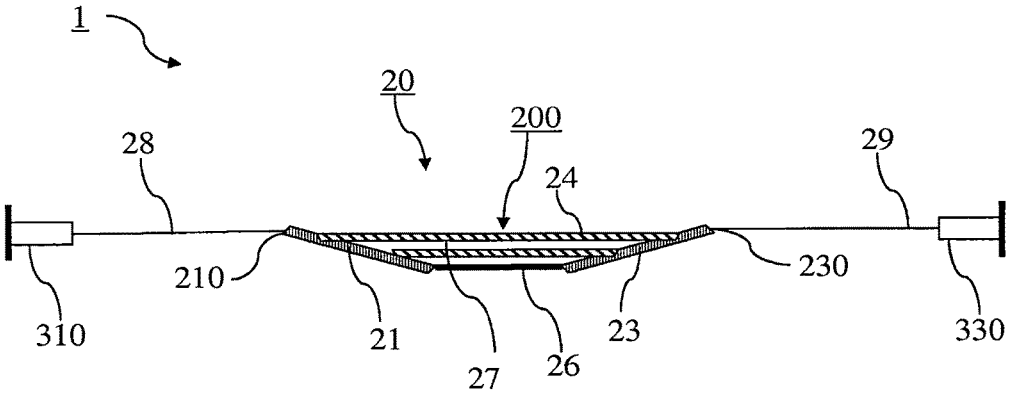
FIG. 4 is a side view of the stretched device from FIG. 3.
Figure 3:
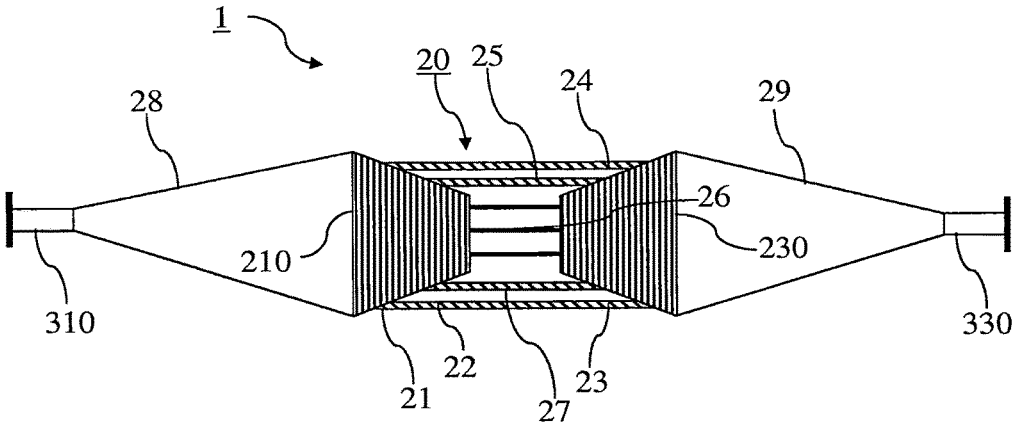
FIG. 3 is a top view of the gaming device when stretched as per the first embodiment of the invention.

The overall shape of the basket can vary. For example, in the resting position, the basket (20) can be a cube, a parallelogram, an inverted pyramid, possibly truncated as shown in FIG. 2, or even free shapes. When the basket is fully stretched, the basket stretches over a substantially flat surface. FIGS. 3 and 4 show an almost fully stretched gaming device. When fully stretched, the front side (25), the rear side (27), the bottom wall (26) and the two side walls (21, 24) are flat with respect to each other.

The basket has two rigid sidewalls (21, 23). The rigid walls can for example be made of wood or any rigid plastic, such as Polyvinyl chloride (PVC) or polyethylene for example. The walls may be solid or perforated. According to a preferred embodiment, the walls have holes to reduce resistance to the movement of the basket.

The two rigid walls (21, 23) are provided on both ends of the basket, towards the handles. In other words, the rigid walls (21, 23) are on opposite sides in the basket (20). The shape of these walls can vary depending on the shape of the basket. For example, they can be shaped like an inverted diamond when the basket (20) is a truncated inverted pyramid, or like a square when the basket (20) is a cube. Free or more complex shapes are possible. For example, these walls (21, 23) can each have two intersecting surfaces, when the top opening (200) is in the shape of a hexagon. This embodiment allows for a channel inside the basket (20) at the intersection of the two surfaces of a rigid wall, which makes it easier to guide the projectile towards the bottom of the basket (20) when the projectile is caught. This channel can also direct a moving projectile towards a channel located on another wall, for example shortly after it is caught, for juggling or artistic figures.

The two rigid walls (21, 23) are interconnected by different parts forming the other walls of the basket (20). The front wall (25) and the rear wall (27) of the basket (20) are formed by the primary parts (22, 24) having flexible and elastic means. These two parts hence connect the side edges of the rigid walls (21, 23). The primary flexible and elastic parts can for example have multiple strips or ribbons arranged in an overall transversal direction with respect to the device. For example, these primary parts can be fabric strips made of an elastomer or rubber.

Figure 5:
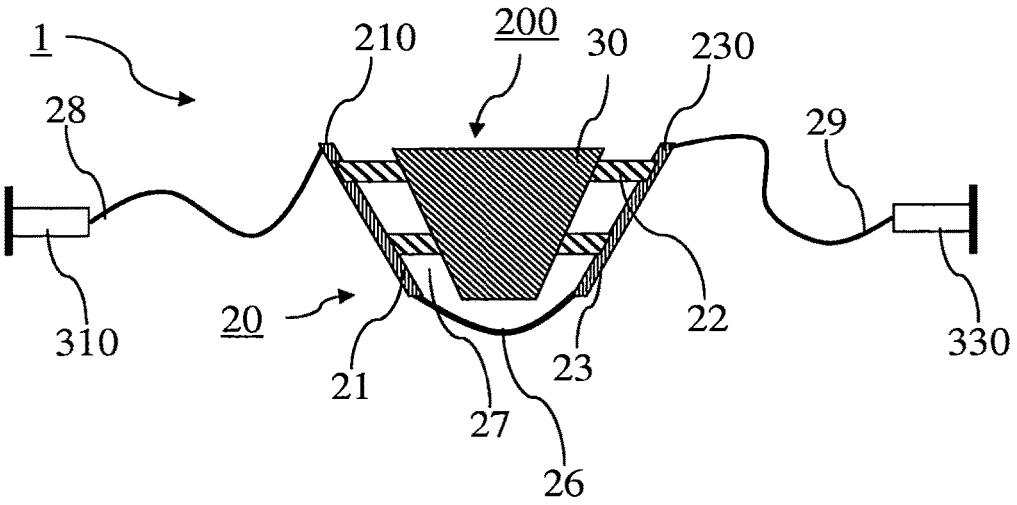
FIG. 5 is a top view of the gaming device in resting position as per a first embodiment of the invention.

The flexible and elastic means enable the basket to return to its resting position after the gaming device (1) is stretched. They may be relatively small in length depending on the overall shape of the basket, thus reducing the risk of injury in case of breakage. As shown in FIG. 5, the primary parts may have both flexible and elastic means and another rigid wall (30). This embodiment allows for a sturdy basket (20). Preferentially, the front (25) and rear (27) walls are fully formed by flexible and elastic means as shown in FIG. 1-4.

The two rigid walls (21, 23) are further connected by a secondary flexible and non elastic system (26). This part will be best shown in FIG. 2. This part (26) forms a bottom surface of the basket. The secondary flexible and non elastic systems can for example have multiplicity of strips or ribbons provided as per any orientation in fabric with high tenacity fibres, such as polyester or polypropylene straps. This part limits the maximum stretching of the gaming device, and thus limits rebound effects without completely eliminating them. This makes it easier to catch the projectile when the user brings the two rigid walls as close as possible to each other, but this can also allow a small rebound when the user keeps this flexible part (26) slightly stretched. Preferentially, the bottom surface of the basket further has a rigid part, for example, a moulded plastic or metal part. This rigid part is preferably placed at the centre of the bottom surface of the basket, on the outer side of the receiving hopper. This part can, for example, be a square covering at least 20%, or even at least 50% of the bottom surface of the basket. Alternatively, this rigid part can be placed on the edges of the bottom surface, at the junctions with the sidewalls, the front and the rear walls. This part helps in further reducing the risk of the hopper overturning.

Each handle is connected to a top edge of a rigid wall (21, 23). The top edge (210, 230) of each of the rigid walls (21, 23) coincides with a side edge of the top opening (200). In other words, the side edges of the opening are formed by the top edges of the rigid walls (21, 23), with the other parts of the edge of the top opening (200) being formed by the top portions of the primary parts (22, 24). The top edges (210, 230) are not necessarily straight. In the case of irregularly shaped rigid walls (21, 23), the top edges may be curved.

Each of the handles is connected to a top edge (210, 230) by the tertiary parts (28, 29). These tertiary parts are non-elastic in nature. They can for example be flexible and non elastic systems, similar in nature to the second system (26), or ropes or cords. According to a preferred embodiment, these parts have a surface with the same width as the length of the top edges (210, 230) of the sidewalls (21, 23) close to the said edges, with the surface width gradually reducing in the direction of the handles (310,330). This embodiment makes it easier to catch the projectile when the latter falls on these parts rather than in the basket (20). Alternately, these tertiary parts can be rigid. According to a preferred embodiment, the tertiary parts (28) are connected to the top edge at a minimum of two points of contact. With this embodiment, the basket (20) is less susceptible to rotational movements. Even more preferably, the two points of contact between the top edge and the tertiary parts (28) are located close to the front (25) and rear (27) walls. This embodiment is even more effective in preventing the rotation of the basket (20).

To operate the gaming device (1), the handles are preferably arranged in continuity with the tertiary parts, similar to a straight handlebar of a cycle, for easy handling of the device.

Preferentially, the tertiary part (28, 29) is connected to a top edge (210, 230) of a rigid sidewall (21, 23) along its entire length or at least at two offset points of the edge close to the connections between the rigid sidewalls (21, 23) and the primary parts (22, 24), as shown in FIG. 1. This reduces the risk of the unwanted rotation of the basket.

The projectile can be of different types, such as a ball, balloon, a shuttlecock or similar projectiles.

This invention was described in connection with specific embodiments that have a purely illustrative value and must not be considered as limiting. Generally, it will be apparent to those skilled in the art that this invention is not limited to the examples illustrated and/or described above. The presence of reference numbers in the drawings cannot be considered as limiting.

The use of verbs such as "to comprise", "to include" "to consist of", or any other variant, as well as their conjugations, in no way excludes the presence of elements other than those mentioned.

The use of the indefinite article "a", "an", or the definite article "the", to introduce an element does not exclude the presence of several of these elements.

The invention claimed is:

1. A gaming device to throw and catch a projectile, comprising a basket for throwing and catching, with said basket having a top opening, and two opposing handles, wherein the basket has two rigid and opposing sidewalls interconnected by two primary parts respectively forming a front and a rear wall of the basket and having flexible and elastic means, the two rigid sidewalls being further interconnected by a secondary non-elastic part forming a bottom wall of the basket, each rigid sidewall of the two rigid sidewalls has a top edge that coincides with a side edge of the top opening of the basket;

and wherein each handle is connected to the top edge by non-elastic tertiary parts.

2. The gaming device according to claim 1, wherein the two primary parts are flexible and elastic means.

3. The gaming device according to claim 1, wherein the non-elastic tertiary parts are flexible parts.

4. The gaming device according to claim 1, wherein the two opposing handles are arranged in continuity with the non-elastic tertiary parts.

5. The gaming device according to claim 1, wherein the top edges of the two rigid sidewalls are straight.

6. The gaming device according to claim 1, wherein the two rigid sidewalls are made of wood or plastic.

7. The gaming device according to claim 1, wherein the two rigid sidewalls have additional openings.

8. The gaming device according to claim 1, further comprising a projectile.

9. The gaming device according to the claim 8, wherein the projectile is a ball or a shuttlecock.

10. The gaming device according to claim 1, wherein the non-elastic tertiary parts are connected to the top edges of the two rigid sidewalls by at least two connections.

11. The gaming device according to claim 10, wherein said at least two connections are respectively located close to the front and the rear walls.

12. The gaming device according to claim 1, wherein the non-elastic tertiary parts are connected to the top edges of the two rigid sidewalls by at least one hinge joint or at least one pivot having a rotational axis that is parallel to the top edge of at least one rigid sidewall of the two rigid sidewalls.

* * * * *